United States Patent [19]

Sakai et al.

[11] 4,365,014

[45] Dec. 21, 1982

[54] ELECTROPHOTOGRAPHIC PHOTOCONDUCTOR

[75] Inventors: Kiyoshi Sakai; Mitsuru Hashimoto; Masafumi Ohta, all of Numazu; Masaomi Sasaki, Shizuoka, all of Japan

[73] Assignee: Ricoh Company, Limited, Tokyo, Japan

[21] Appl. No.: 79,406

[22] Filed: Sep. 27, 1979

[30] Foreign Application Priority Data

Sep. 29, 1978 [JP] Japan ..... 53-119949

[51] Int. Cl.[3] ..... G03G 5/06; G03G 5/14

[52] U.S. Cl. ..... 430/59; 430/57; 430/58; 430/79

[58] Field of Search ..... 430/59, 79, 70–78, 430/80–83, 57, 58

[56] References Cited

U.S. PATENT DOCUMENTS

| | | | |
|---|---|---|---|
| 3,066,023 | 11/1962 | Schlesinger | 430/79 |
| 4,150,987 | 3/1979 | Anderson et al. | 430/77 |
| 4,256,821 | 3/1981 | Enomoto et al. | 430/59 |
| 4,278,747 | 7/1981 | Murayama et al. | 430/82 |

FOREIGN PATENT DOCUMENTS

| | | | |
|---|---|---|---|
| 930988 | 7/1963 | United Kingdom | 430/70 |

*Primary Examiner*—Mary F. Downey

*Attorney, Agent, or Firm*—Blanchard, Flynn, Thiel, Boutell & Tanis

[57] ABSTRACT

An electrophotographic photoconductor is prepared by forming a photoconductive layer containing a hydrazone compound therein on an electroconductive support member. The hydrazone compounds represented by the following general formula, are useful as photoconductive materials and as charge transport materials for use in electrophotography:

wherein $R_1$ represents a methyl group, an ethyl group, a 2-hydroxyethyl group, or a 2-chloroethyl group, and $R_2$ represents a methyl group, an ethyl group, a benzyl group or a phenyl group.

6 Claims, 3 Drawing Figures

ELECTROPHOTOGRAPHIC PHOTOCONDUCTOR

BACKGROUND OF THE INVENTION

The present invention relates to an electrophotographic photoconductor and more particularly to an electrophotographic photoconductor comprising an electroconductive support member and a photoconductive layer containing a hydrazone compound represented by the following general formula (1) therein, which is formed on the electroconductive support member:

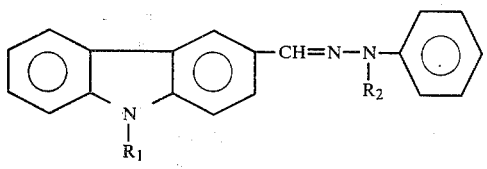

(1)

wherein $R_1$ represents a methyl group, an ethyl group, a 2-hydroxyethyl group, or a 2-chloroethyl group, and $R_2$ represents a methyl group, an ethyl group, a benzyl group or a phenyl group.

Conventionally, inorganic materials, such as selenium, cadmium sulfide, and zinc oxide, are used as the photoconductive materials for use in electrophotography. In the electrophotography, the surface of a photoconductor is charged, for example, by exposing the surface to corona discharge in the dark, and the photoconductor is then exposed to a light image, whereby electric charges are selectively conducted away from the exposed area on the surface of the photoconductor, resulting in that a latent electrostatic image is formed on the surface of the photoconductor. The thus formed latent electrostatic image is developed with toner comprising coloring materials, such as dyes and pigments, and binder materials made of polymers. As the indispensable fundamental characteristics of a photoconductor material for use in the electrophotography, the following characteristics are required:

(1) the photoconductor can be charged to an appropriate potential in the dark; (2) electric charges are not conducted away in the dark from the surface of the photoconductor; (3) electric charges are readily conducted away from the surface of the photoconductor under illumination. The above-mentioned inorganic materials to be used as the photoconductive materials for use in the electrophotography have, in fact, an excellent quality, but they still have various shortcomings at the same time.

For instance, selenium, which is now widely used, can meet the above-mentioned requirements of (1) through (3) sufficiently. However, its production is difficult and the production cost is high. More specifically, selenium is not flexible enough for use in a belt-like form and is vulnerable and poor in heat and mechanical resistance.

Cadmium sulfide and zinc oxide are respectively dispersed in a binder resin and formed into photoconductors for use in electrophotography. However, the thus prepared photoconductors are respectively poor in the surface smoothness, hardness, tensile strength and abrasion resistance. Therefore, they cannot be used repetitively for a long period of time as they are.

Recently, a variety of electrophotographic photoconductors containing various organic materials have been proposed to eliminate the above-mentioned shortcomings of the inorganic materials. As a matter of fact, some of them are practically used. For instance, the following photoconductors are used in practice: a photoconductor comprising poly-N-vinylcarbazole and 2,4,7-trinitrofluorene-9-one (U.S. Pat. No. 3,484,237); a photoconductor consisting essentially of azo pigments (U.S. Pat. No. 3,775,105); and a photoconductor consisting essentially of an eutectic cacrystalline substance comprising a dye and a resin (U.S. Pat. No. 3,684,502 and U.S. Pat. No. 3,732,180). These photoconductors have excellent characteristics and high practical value in fact. However, they still have their own shortcomings in view of the requirements for use in electrophotography.

SUMMARY OF THE INVENTION

It is therefore an object of the present invention to provide an electrophotographic photoconductor, eliminating the above-mentioned shortcomings of the conventional electrophotographic photoconductors.

According to the present invention, the electrophotographic photoconductor is prepared by forming a photoconductive layer containing a hydrazone compound therein on an electroconductive support member. The hydrazone compounds represented by the following general formula, are useful as photoconductive materials and as charge transport materials for use in electrophotography:

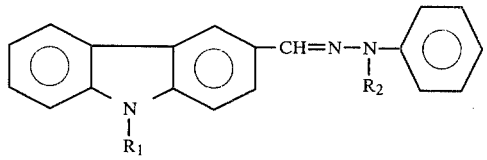

wherein $R_1$ represents a methyl group, an ethyl group, a 2-hydroxyethyl group, or a 2-chloroethyl group, and $R_2$ represents a methyl group, an ethyl group, a benzyl group or a phenyl group.

BRIEF DESCRIPTION OF THE DRAWINGS

For a better understanding of the invention as well as other objects and further features thereof, reference is had to the following detailed description of the invention to be read in connection with the accompanying drawings, wherein.

DETAILED DESCRIPTION OF THE PREFERRED EMBODIMENTS

Figure 1:
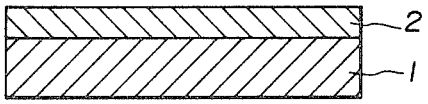
FIG. 1 is an enlarged schematic sectional view of an embodiment of an electrophotographic photoconductor according to the present invention.

The hydrazone compounds represented by the previously mentioned general formula (1) can be prepared by the following ordinary procedure by condensing equal moles of 3-formylcarbazole compound and N-alkylphenylhydrazine compound in alcohol, and, if necessary, a small amount of a condensing agent, such as glacial acetic acid or inorganic acid, is added thereto.

The following are the specific examples of the hydrazone compounds represented by the general formula (1):

(1)

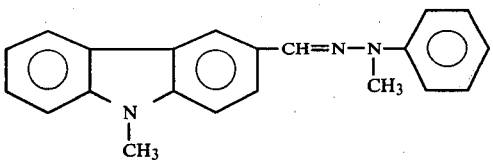

9-Methylcarbazole-3-carbaldehyde 1-methyl-1-phenylhydrazone (2)

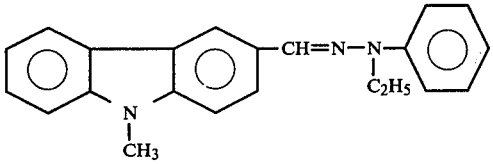

9-Methylcarbazole-3-carbaldehyde 1-ethyl-1-phenylhydrazone (3)

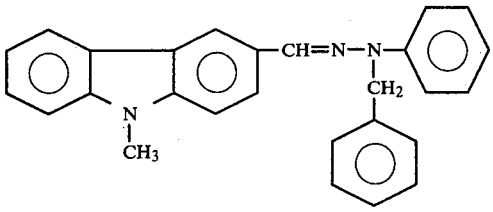

9-Methylcarbazole-3-carbaldehyde 1-benzyl-1-phenylhydrazone (4)

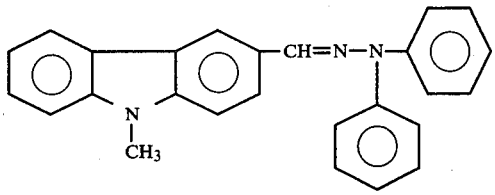

9-Methylcarbazole-3-carbaldehyde 1,1-diphenylhydrazone (5)

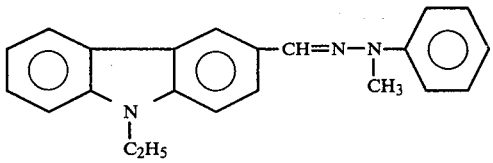

9-Ethylcarbazole-3-carbaldehyde 1-methyl-1-phenylhydrazone (6)

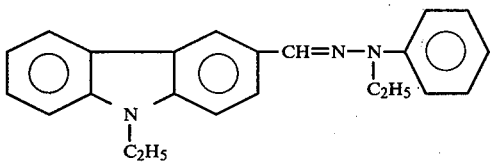

9-Ethylcarbazole-3-carbaldehyde 1-ethyl-1-phenylhydrazone (7)

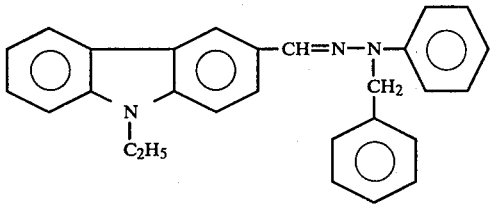

9-Ethylcarbazole-3-carbaldehyde 1-benzyl-1-phenylhydrazone

-continued (8)

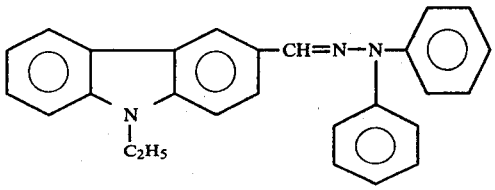

9-Ethylcarbazole-3-carbaldehyde 1,1-diphenylhydrazone (9)

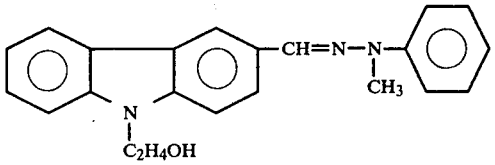

9-(β-Hydroxyethyl)carbazole-3-carbaldehyde 1-methyl-1-phenylhydrazone (10)

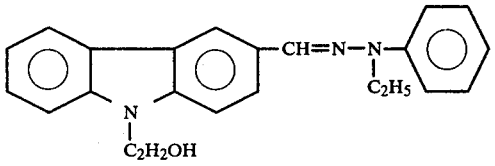

9-(β-hydroxyethyl)carbazole-3-carbaldehyde 1-ethyl-1-phenylhydrazone (11)

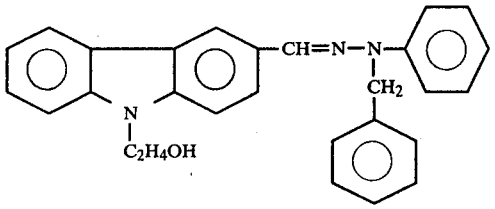

9-(β-Hydroxyethyl)carbazole-3-carbaldehyde 1-benzyl-1-phenylhydrazone (12)

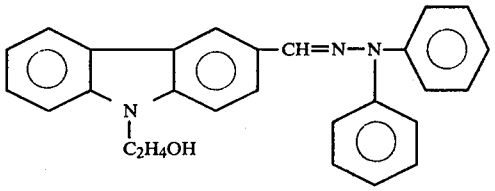

9-(β-Hydroxyethyl)carbazole-3-carbaldehyde 1,1-diphenylhydrazone (13)

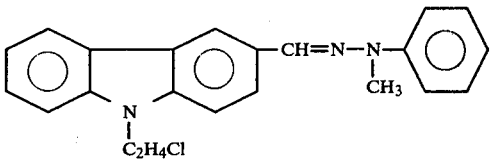

9-(β-Chloroethyl(carbazole-3-carbaldehyde 1-methyl-1-phenylhydrazone (14)

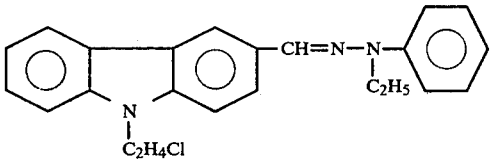

9-(β-Chloroethyl)carbazole-3-carbaldehyde 1-ethyl-1-phenylhydrazone

-continued (15)

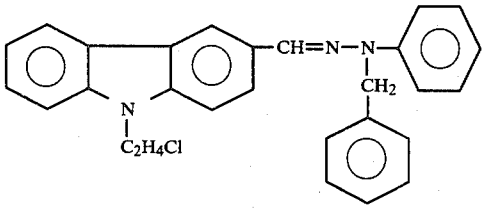

9-(β-Chloroethyl)carbazole-3-carbaldehyde 1-methyl-1-phenylhydrazone (16)

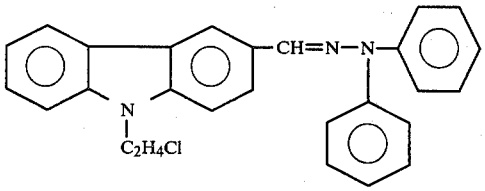

9-(β-Chloroethyl)carbazole-3-carbaldehyde 1,1-diphenylhydrazone

Figure 2:
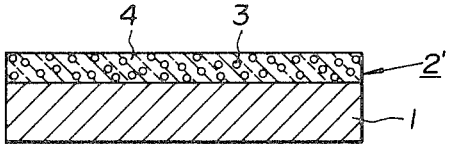
FIG. 2 is an enlarged sectional view of another embodiment of an electrophotographic photoconductor according to the present invention.
Figure 3:
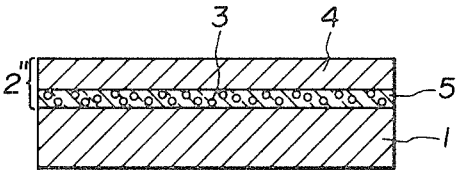
FIG. 3 is an enlarged sectional view of a further embodiment of an electrophotographic photoconductor according to the present invention.

The photoconductive materials for use in the present invention contain any of the above hydrazone compounds. By use of any of the photoconductive materials, the photoconductors according to the present invention are prepared as shown in FIG. 1 through FIG. 3. Referring to FIG. 1, there is shown one embodiment of a photoconductor according to the present invention, in which a photoconductive layer 2 comprising a hydrazone compound, a sensitizer dye and a binder agent (resin), is formed on an electroconductive support member 1. Referring to FIG. 2, there is shown another embodiment of a photoconductor according to the present invention, in which, on the electroconductive support member 1, there is formed a photoconductive layer 2' wherein a charge carrier producing material 3 is dispersed in a charge transport medium 4 comprising a hydrazone compound and a binder agent. Referring to FIG. 3, there is shown a further embodiment of a photoconductor according to the present invention, in which on the electroconductive support member 1, there is formed a photoconductive layer 2" comprising a charge carrier producing layer 5 consisting essentially of the charge carrier producing material 3, and the charge transport layer 4.

In the photoconductor as shown in FIG. 1, the hydrazone compound acts as a photoconductive material, and the production and movement of charge carriers necessary for light decay of the photoconductor are performed through the hydrazone compound. The hydrazone compounds, however, scarcely absorb light in the visible light range. Therefore, in order to form images by visible light, it is necessary to sensitize the hydrazone compounds by adding a sensitizer dye which absorbs visible light to the photoconductive layer 2.

In the case of the photoconductor as shown in FIG. 2, the hydrazone compound and a binder agent (or the combination of a binder agent and a plasticizer) constitute a charge transport medium 4, while a charge carrier producing material, such as an inorganic or organic pigment, produces charge carriers. In this photoconductor, the charge transport medium 4 serves to receive charge carriers mainly produced by the charge carrier producing material and to transport the charge carriers. A fundamental requirement for the photoconductor is that the absorption wavelength range of the charge carrier producing material and that of the hydrazone compound do not overlap each other in the visible light range. This is because it is required that light reach the surface of the charge carrier producing material in order that the charge carrier producing material produces charge carriers sufficiently. A feature of the hydrazone compounds for use in the present invention is that the hydrazone compounds scarcely absorb light in the visible light range and that they serve effectively as charge transport materials when they are combined with a charge carrier producing material which generally absorbs visible light and produces charge carriers.

In the photoconductor as shown in FIG. 3, light passes through the charge transport layer 4 and reaches the charge carrier producing layer 5 where charge carriers are produced, while the charge transport layer 4 receives and moves the charge carriers, and the charge carriers necessary for dark decay of the photoconductor are produced by the charge carrier producing material and moved by the charge transport medium, in particular by the hydrazone compounds in the present invention. This mechanism is the same as that of the photoconductor shown in FIG. 2. Furthermore, the hydrazone compounds serve as charge transport materials as well in this case.

The photoconductor as shown in FIG. 1 is prepared as follows: A hydrazone compound is dissolved a solution of a binder and if necessary, a sensitizer dye is added to the solution and the solution is then coated on the electroconductive support member 1. The coated layer is then dried. The photoconductor as shown in FIG. 2 is prepared as follows: A powder-like charge carrier producing material is dispersed in a solution of a hydrazone compound and a binder agent. The thus prepared dispersion is coated on the electroconductive support member 1 and the coated layer is then dried. The photoconductor as shown in FIG. 3 is prepared as follows: A charge carrier producing material is evaporated in vacuum onto the electroconductive support member 1, or a powder-like charge carrier producing material is dispersed in an appropriate solvent, and if necessary, with addition of a binder agent thereto, and the dispersion is then coated on the electroconductive support member 1 and the coated layer is dried. The surface of the coated layer is finished by buffing if necessary and the thickness of the coated layer is adjusted. Thereafter, a solution of a hydrazone compound and a binder agent is applied to the above-mentioned layer and is then dried. The coating can be performed in an ordinary manner, for instance, by use of a doctor blade or a wire bar.

In the photoconductors in FIG. 1 and FIG. 2, the thickness of each of the photoconductive layers 2 and 2' is in the range of 3 μm to 50 μm, preferably in the range of 5 μm to 20 μm. Furthermore, in the photoconductor in FIG. 3, the thickness of the charge carrier producing layer 5 is not more than 5 μm, preferably not more than 2 μm, and the thickness of the charge transport layer is in the range of 3 μm to 50 μm, preferably in the range of 5 μm to 20 μm. In the photoconductor in FIG. 1, the content of a hydrazone compound in the photoconductive layer 2 is in the range of 30 wt% to 70 wt%, preferably about 50 wt% with respect to the weight of the photoconductive layer 2, and the content of a sensitizer dye for giving photosensitivity in the visible light range to the photoconductive layer 2 is in the range of 0.1 wt% to 5 wt%, and preferably in the range of 0.5 wt% to 3 wt% with respect to the weight of the photoconductive layer 2. In the photoconductor in FIG. 2, the content of a hydrazone compound in the photoconductive layer 2' is in the range of 10 wt% to 95 wt%, preferably in the range of 30 wt% to 90 wt%, while the content of a charge carrier producing material is not more than 50 wt%, preferably not more than 20 wt%, with respect to the weight of the photoconductive layer 2', respectively. The content of a hydrazone compound in the charge transport layer 4 of the photoconductor in FIG. 3 is in the range of 10 wt% to 95 wt%, preferably in the range of 30 wt% to 90 wt% as in the case of the photoconductive layer of the photoconductor in FIG. 2. When preparing the photoconductors in FIG. 1 through FIG. 3, a plasticizer can be used in combination with a binder agent.

As the electroconductive support member 1 for use in the present invention, the following can be employed: metal plate and foil, such as aluminum plate and aluminum foil, and plastic film with a metal, such as aluminum, evaporated thereon, and paper treated so as to be electrically conductive.

As the binder agents for use in the present invention, the following can be employed: polyamide, polyurethane, polyester, epoxy resin, condensed resins, such as polyketone and polycarbonate, and vinyl polymers such as polyvinyl ketone, polystyrene, poly-N-vinylcarbazole, and polyacrylamide, and any other electrically insulating and adhesive resins.

As the plasticizers for use in the present invention, the following can be employed: halogenated paraffin, polybiphenyl chloride, dimethylnaphthalene and dibutyl phthalate.

As the sensitizers for use in the photoconductive layer 2 of the photoconductor in FIG. 1, the following can be employed: triarylmethane dye, such as Brilliant Green, Victoria Blue B, Methyl Violet, Crystal Violet and Acid Violet 6 B, and xanthene dye, such as Rhodamine B, Rhodamine 6G, Rhodamine G Extra, Eosine S, erythrosine, Rose Bengale and Fluorescein, and thiazine dye, such as Methylene Blue, and cyanine dye, such as cyanin, and pyrylium dye, such as 2,6-diphenyl-4-(N,N-dimethylaminophenyl) thiapyrylium-perchlorate and benzopyrylium salt.

As the charge carrier producing materials for use in the photoconductors as shown in FIG. 2 and FIG. 3, the following can be employed:

1. Inorganic pigments, such as selenium, selenium-tellurium, cadmium sulfide and cadmium sulfide-selenium.
2. Organic pigments, such as C.I. Pigment Blue-25 (Color Index C.I. 21180 or Diane Blue), C.I. Pigment Red 41 (C.I. 21200), C.I. Acid Red 52 (C.I. 45100) and C.I. Basic Red 3 (C.I. 45210)
3. Azo pigments having a carbazole group as represented by the general formula:

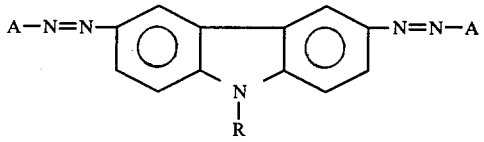

(U.S. Patent Application Ser. No. 872,679 and Corresponding Japanese Patent Application No. 52-8740)

4. Azo pigments having a styrylstilbene group as represented by the general formula:

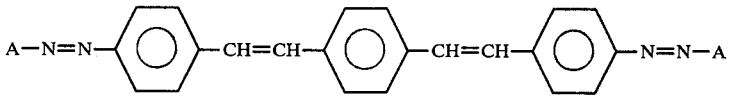

(U.S. Patent Application Ser. No. 898,130 and Corresponding Japanese Patent Application No. 52-48859)

5. Azo pigments having a triphenylamine group as represented by the general formula:

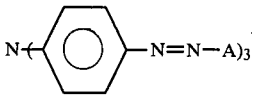

(U.S. Patent Application Ser. No. 897,508 and Corresponding Japanese Patent Application No. B 52-45812)

6. Azo pigments having a dibenzothiophene group as represented by the general formula:

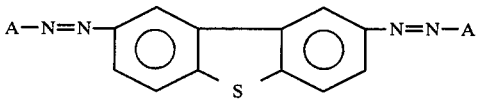

(U.S. Patent Application Ser. No. 925,157 and Corresponding Japanese Patent Application No. 52-86255)

7. Azo pigments having an oxadiazole group as represented by the general formula:

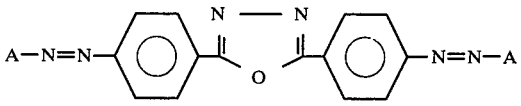

(U.S. Patent Application Ser. No. 908,116 and Corresponding Japanese Patent Application No. 52-77155)

8. Azo pigments having a fluorenone group as represented by the general formula:

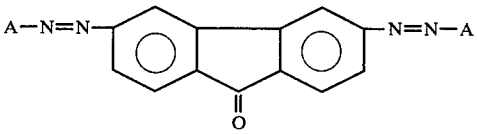

(U.S. Patent Application Ser. No. 925,157 and Corresponding Japanese Patent Application No. 52-87351)

9. Azo pigments having bis-stilbene groups as represented by the general formula:

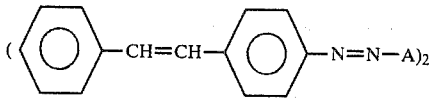

(U.S. Patent Application Ser. No. 922,526 and Corresponding Japanese Patent Application No. 52-81790)

10. Azo pigments having distyryloxadiazole group as represented by the general formula:

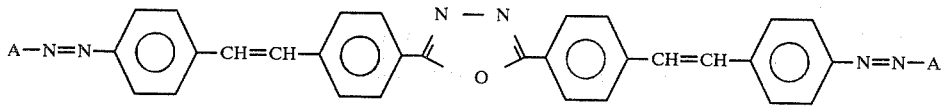

(U.S. Patent Application Ser. No. 908,116 and Corresponding Japanese Patent Application No. 52-66711)

11. Azo pigments having a distyrylcarbazole group as represented by the general formula:

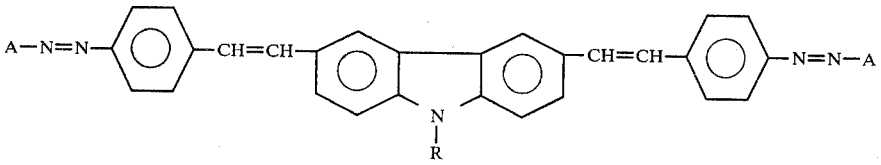

(U.S. Patent Application Ser. No. 921,086 and Corresponding Japanese Patent Application No. 52-81791)

12. Phthalocyanine pigments, such as C.I. Pigment Blue 16 (C.I. 74100)
13. Indigo pigments, such as C.I. Vat Brown 5 (C.I. 73410) and C.I. Vat Dye (C.I. 73030)
14. Perylene pigments, such as A190 Scarlet B (commercially available from Bayer A.G.) and Indanthren Scarlet R (commercially available from Bayer A.G.).

In the thus obtained photoconductors, if necessary, an adhesive layer or a barrier layer can be disposed between the electroconductive support member 1 and the photoconductive layer 2, 2' or 2''. Polyamide, nitrocellulose, or aluminum oxide is used in the adhesive layer or the barrier layer, and it is preferable that the thickness of the adhesive layer or the barrier layer be not more than 1 μm.

When copying is made by use of any of the photoconductors according to the present invention, the surface of the photoconductor is charged and is then exposed to a light image to form a latent electrostatic image. The thus formed latent electrostatic image is developed with toner, and if necessary, the developed toner image is transferred to paper. The photoconductors according to the present invention have a high photosensitivity and are very flexible.

EXAMPLE 1

To two parts by weight of Diane Blue (C.I. Pigment Blue 25 C.I. 21180) were added 98 parts by weight of tetrahydrofuran. The mixture of Diane Blue and tetrahydrofuran was ground in a ball mill so that a charge carrier producing pigment dispersion was prepared. This dispersion was coated on an aluminum evaporated polyester film by a doctor blade and was then air-dried at room temperature, so that a 1 μm thick charge carrier producing layer was formed on the aluminum evaporated polyester film.

Two parts by weight of 9-(ethylcarbazole-3-carbaldehyde 1-methyl-1-phenylhydrazone which is represented by the formula (5),

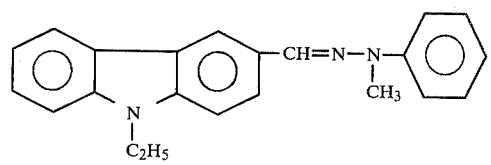

(5)

3 parts by weight of polycarbonate (Panlite L commercially available from Teijin Co., Ltd.) and 45 parts of tetrahydrofuran were mixed so that a charge transporting layer formation liquid was prepared. The thus prepared charge transporting layer formation liquid was coated on the charge carrier producing layer by a doctor blade and was then dried at 100° C. for 10 minutes so that an approximately 10 μm thick charge transporting layer was formed on the charge carrier producing layer. Thus, an electrophotographic photoconductor No. 1 according to the present invention was prepared.

The electrophotographic photoconductor was charged negatively in the dark under application of −6 kV of corona charge for 20 seconds and was then allowed to stand in the dark for 20 seconds without applying any charge thereto. At this moment, the surface potential Vpo (V) of the photoconductor was measured by Paper Analyzer (Kawaguchi Electro Works, Model SP-428). The photoconductor was then illuminated by a tungsten lamp in such a manner that the illuminance on the illuminated surface of the photoconductor was 20 lux, so that the exposure $E_{\frac{1}{2}}$(lux. second) required to reduce the initial surface potential Vpo (V) to $\frac{1}{2}$ the initial surface potential Vpo (V) was measured. The results showed that Vpo = −870 V and $E_{\frac{1}{2}}$ = 3.7 lux.-second.

EXAMPLE 2

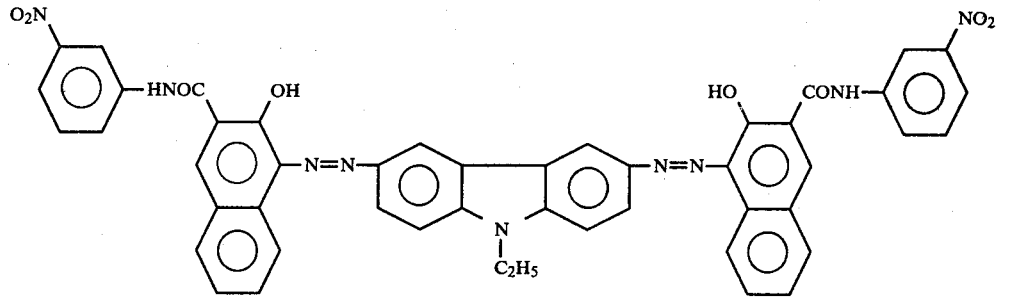

| | |
|---|---|
| Charge carrier producing pigment | 3 parts by weight |
| Polyester resin (Polyester Adhesive 49000 commercially available from Dupont) | 1 part by weight |
| Tetrahydrofuran | 96 parts by weight |

A mixture of the above-mentioned components was ground in a ball mill so that a charge carrier producing pigment dispersion was prepared. This dispersion was coated on an aluminum evaporated polyester film by a doctor blade and was then dried at 80° C. in a drier for 5 minutes, so that a 1 μm thick charge carrier producing layer was formed on the aluminum evaporated polyester film.

Then, two parts by weight of 9-ethylcarbazole-3-carbaldehyde 1-benzyl-1-phenylhydrazone, which is represented by the formula,

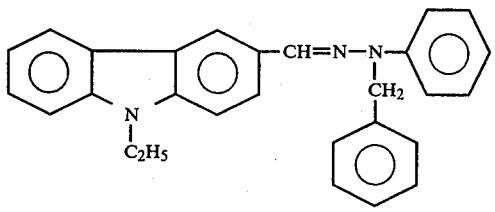

(7)

3 parts by weight of polycarbonate (Panlite L commercially available from Teijin Co., Ltd.) and 45 parts by weight of tetrahydrofuran were mixed so that a charge transporting layer formation liquid was prepared.

The thus prepared charge transport layer liquid was coated on the charge carrier producing layer by a doctor blade and was then dried at 100° C. for 10 minutes so that a 10 μm thick charge transport layer was formed on the charge carrier producing layer. Thus electrophotographic photoconductor No. 2 according to the present invention was prepared.

As in the case of Example 1, the electrophotographic photoconductor was charged negatively in the dark under application of −6 kV of corona charge for 20 seconds, and was then allowed to stand in the dark for 20 seconds without applying any charge thereto, and as in the case of Example 1, Vpo and $E_{\frac{1}{2}}$ were measured. The results showed that Vpo=−690 V and $E_{\frac{1}{2}}$=9.9 lux. second.

EXAMPLE 3

In Example 2,

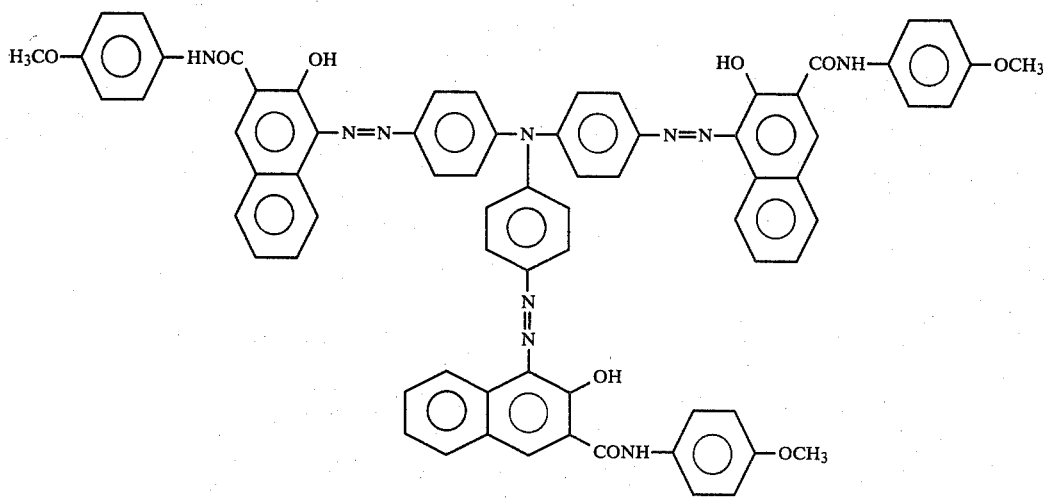

was employed as the charge carrier producing pigment, and 9-ethylcarbazole-3-carbaldehyde-1,1-diphenylhydrazone represented by the formula (8)

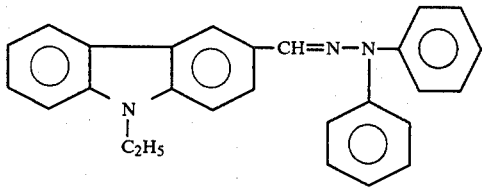

was employed as the charge transport material. Under the same conditions as in Example 2, a 1.0 μm thick charger carrier producing layer was formed on an aluminum evaporated polyester film, and a 12 μm thick charge transport layer was formed on the charge carrier producing layer. Thus, an electrophotographic photoconductor No. 3 was prepared, and Vpo and $E_{\frac{1}{2}}$ were measured likewise. The results showed that Vpo = −1210 V and $E_{\frac{1}{2}}$ = 7.5 lux. second.

EXAMPLE 4

In Example 2, was employed as the charge carrier producing pigment, and 9-ethylcarbazole-3-carbaldehyde-1-methyl-1-phenylhydrazone represented by formula

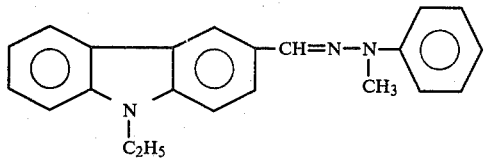

(5)

was employed as the charge transport material. Under the same conditions as in Example 2, a 0.5 μm thick charge carrier producing layer was formed on an aluminum evaporated polyester film, and a 10 μm thick charge transport layer was formed on the charge carrier producing layer. Thus, an electrophotographic photoconductor No. 4 was prepared, and Vpo and $E_{\frac{1}{2}}$ were measured likewise. The results showed that Vpo = −830 V and $E_{\frac{1}{2}}$ = 1.3 lux. second.

Each of the electrophotographic photoconductors prepared in Examples 1 to 4 was negatively charged by a commercially available copying machine and a latent image was formed on each photoconductor and was developed with a positively charged dry type toner. The thus developed toner image was transferred elec-

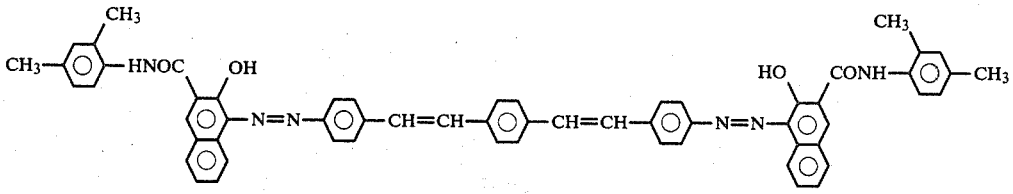

trostatically to a high quality transfer sheet and was fixed to the transfer sheet. As a result, a clear toner image was obtained from each electrophotographic photoconductor. In the case where a wet type developer was used instead of the dry type toner, a clear image was also obtained from each photoconductor.

EXAMPLE 5

A 1 μm thick charge carrier producing layer consisting of selenium was formed on an approximately 300 μm thick aluminum plate by vacuum evaporation. Then, two parts by weight of 9-methycarbazole-3-carbaldehyde-1-methyl-1-phenylhydrazone represented by the formula (1)

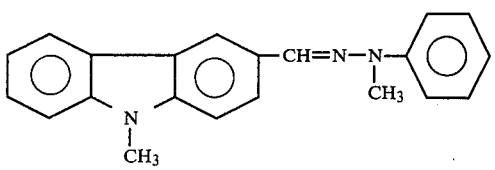

(1)

3 parts by weight of polyester resin (Polyester Adhesive 49000 commercially available from Dupont) and 45 parts by weight of tetrahydrofuran were mixed so that a charge transport layer formation liquid was prepared. The thus prepared charge transport formation liquid was coated on the charge carrier producing layer consisting of selenium by a doctor blade and was then air-dried at room temperature, and was further dried under reduced pressure so that a 10 μm thick charge transport layer was formed on the charge carrier producing layer. Thus, an electrophotographic photoconductor No. 5 according to the present invention was prepared. By the same procedure as in the case of Example 1, Vpo and $E_{\frac{1}{2}}$ were measured. The results showed that Vpo = −1210 V and $E_{\frac{1}{2}}$ = 3.1 lux. second.

EXAMPLE 6

In Example 5, instead of selenium, a perylene pigment C. I. Vat Red 23 (C. I. 71130) represented by the formula

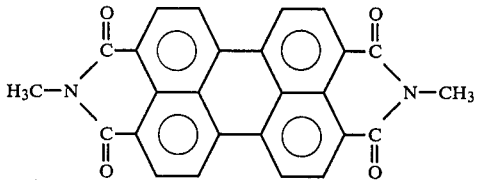

was vacuum-evaporated with the thickness of 0.3 μm on an approximately 300 μm thick aluminum plate so that a charge carrier producing layer was formed. As the charge transport material, 9-(β-hydroxylethyl) carbazole-3-carbaldehyde 1-methyl-1-phenylhydrazone represented by the formula (9) was employed so that a 12 μm thick charge transport layer was formed.

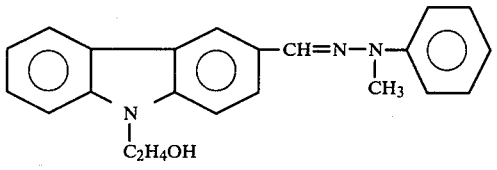

(9)

Under the same condition as in Example 5, except the above-mentioned charge carrier producing layer and charge transport layer, an electrophotographic photoconductor No. 6 according to the present invention was prepared. By the same procedure as in the case of Example 1, Vpo and $E_{\frac{1}{2}}$ were measured. The results showed that Vpo = −1430 V and $E_{\frac{1}{2}}$ = 7.7 lux. second.

Each of the electrophotographic photoconductors prepared in Examples 5 and 6 was negatively charged by a commercially available copying machine and a latent image was formed on each photoconductor and was developed with a positively charged dry type toner. The thus developed toner image was transferred electrostatically to a high quality transfer sheet and was fixed to the transfer sheet. As a result, a clear toner image was obtained from each electrophotographic photoconductor. In the case where a wet type developer was used instead of the dry type toner, a clear image was also obtained from each photoconductor.

EXAMPLE 7

A mixture of one part by weight of Chloro Diane Blue and 158 parts by weight of tetrahydrofuran was ground and mixed in a ball mill. To the mixture were added 12 parts by weight of 9-ethylcarbazole-3-carbaldehyde-1-methyl-1-phenylhydrazone represented by the formula (5)

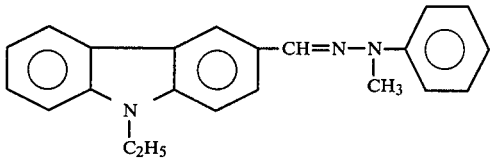

(5)

18 parts by weight of polyester resin (Polyester Adhesive 49000 commercially available from Dupont). The mixture was further mixed so that a photoconductive layer formation liquid was prepared. The thus prepared photoconductor layer formation liquid was coated on an aluminum evaporated polyester film by a doctor blade and was then dried at 100° C. for 30 minutes so that a 16 μm thick photoconductive layer was formed on the aluminum evaporated polyester film. Thus, an electrophotographic photoconductor No. 7 according to the present invention was prepared. The photoconductor was positively charged under application of +6 kV of corona charge. Under the same conditions and by use of the same paper analyzer as in Example 1, Vpo and $E_{\frac{1}{2}}$ were measured. The results showed that Vpo = 1430 V and $E_{\frac{1}{2}}$ = 8.7 lux. second.

EXAMPLE 8

In Example 7, instead of Chloro Diane Blue and 9-ethylcarbazole-3-carbaldehyde-1-methyl-1-phenylhydrazone represented by the formula (5),

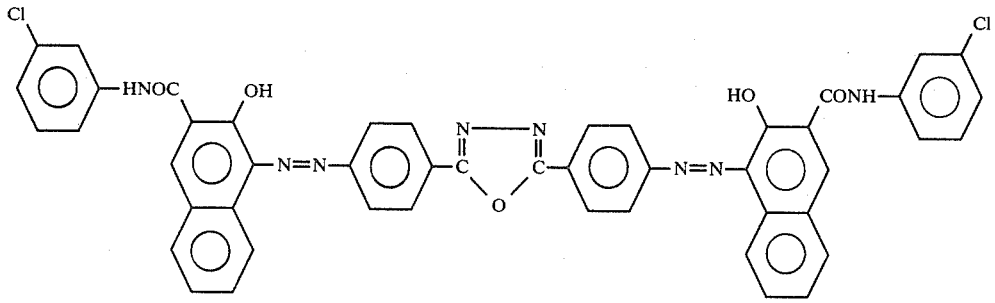

was employed as the charge carrier producing pigment, and 9-(β-hydroxylethyl) carbazole-3-carbaldehyde 1-benzyl-1-phenyhydrazone represented by the formula (11) was employed as the charge transport material.

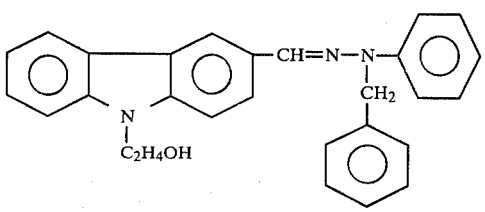

(11)

Under the same conditions as in Example 7, a 12 μm thick photoconductive layer was formed on an aluminum evaporated polyester film, so that an electrophotographic photoconductor No. 8 according to the present invention was prepared. By the same procedure as in the case of Example 1, Vpo and $E_{\frac{1}{2}}$ were measured. The results showed that Vpo=1030 V and $E_{\frac{1}{2}}$=6.7 lux. Second.

EXAMPLE 9

In Example 7, instead of Chloro Diane Blue and 9-ethylcarbazole-3-carbaldehyde-1-methyl-1-phenylhydrazone represented by the formula (5), was employed as the charge carrier producing pigment, and 9-(β-chloroethyl) carbazole-3-carbaldehyde 1-methyl-1-phenylhydrazone represented by the formula (13) was employed as the charge transport material.

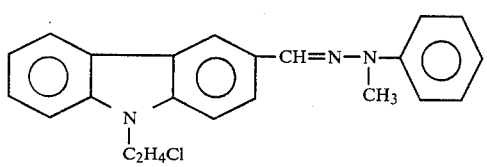

(13)

Under the same conditions as in Example 7, a 12 μm thick photoconductive layer was formed on an aluminum evaporated polyester film, so that an electrophotographic photoconductor No. 9 according to the present invention was prepared. By the same procedure as in the case of Example 1, Vpo and $E_{\frac{1}{2}}$ were measured. The results showed that Vpo=1090 V and $E_{\frac{1}{2}}$=7.3 lux. second.

EXAMPLE 10

In Example 7, instead of Chloro Diane Blue and 9-ethylcarbazole-3-carbaldehyde-1-methyl-1-phenylhydrazone represented by the formula (5),

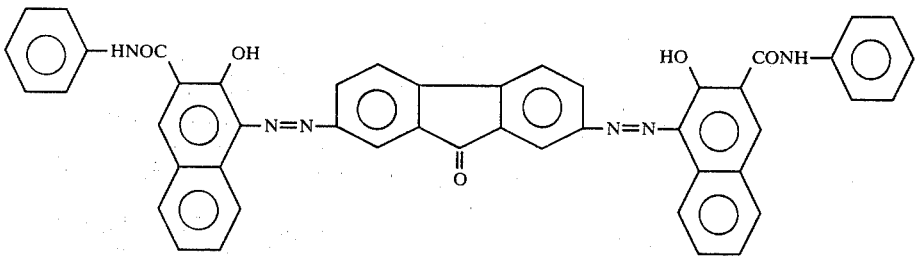

(9)

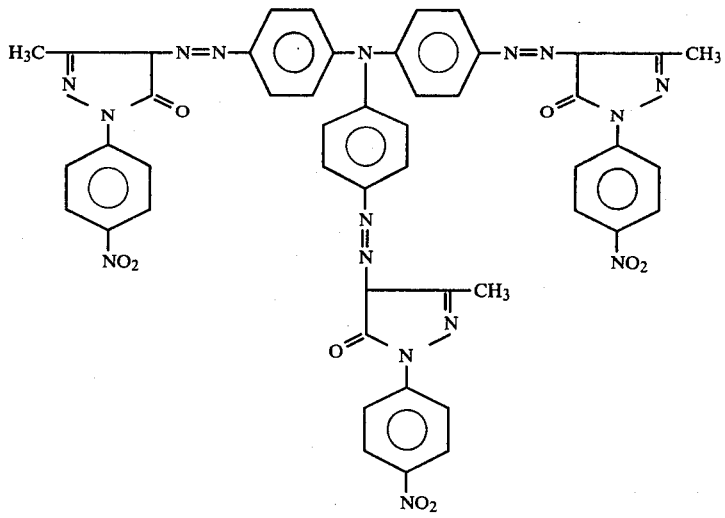

was employed as the charge carrier producing pigment, and 9-(β-chloroethyl) carbazole-3-carbaldehyde 1,1-diphenylhydrazone represented by the formula (16) was employed as the charge transport material.

(16)

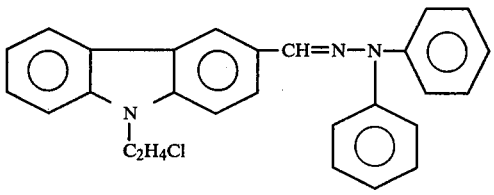

Under the same conditions as in Example 7, a 12 μm thick photoconductive layer was formed on an aluminum evaporated polyester film so that an electrophotographic photoconductor No. 10 according to the present invention was prepared. By the same procedure as in the case of Example 1, Vpo and $E_{\frac{1}{2}}$ were measured. The results showed that Vpo=650 V and $E_{\frac{1}{2}}$=7.5 lux. second.

Each of the electrophotographic photoconductors prepared in Examples 7 to 10 was positively charged by a commercially available copying machine and a latent image was formed on each photoconductor and was developed with a negatively charged dry type toner. The thus developed toner image was transferred electrostatically to a high quality transfer sheet and was fixed to the transfer sheet. As a result, a clear toner image was obtained from each electrophotographic photoconductor. In the case where a wet type developer was used instead of the dry type toner, a clear image was also obtained from each photoconductor.

EXAMPLE 11

One part by weight of 9-(ethylcarbazole-3-carbaldehyde 1-methyl-1-phenylhydrazone which is represented by the formula (5), (5)

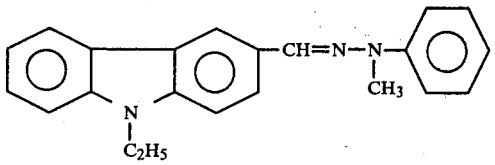

one part by weight of polycarbonate (Panlite L commercially available from Teijin Co., Ltd.) and 0.001 part by weight Crystal Violet were dissolved in 9 parts by weight of 1,2-dichloroethane. The thus prepared photoconductive layer formation liquid was coated on a paper, whose surface was treated so as to be electroconductive, by a wire bar and was then dried at 100° C. for 5 minutes so that an approximately 6 μm thick photoconductive layer was formed on the paper. Thus, an electrophotographic photoconductor No. 11 according to the present invention was prepared.

The electrophotographic photoconductor No. 11 was charged positively to approximately 500 volts by corona discharge and was then exposed to a light image with 200 lux for 0.5 second to form a latent electrostatic image on the photoconductor. The thus formed latent electrostatic image was developed by a wet type developer and an image faithful to the original image was obtained.

What is claimed is:

1. An electrophotographic element comprising:

an electroconductive support member;

a charge carrier producing layer comprising an azo pigment having a styrylstilbene group, as a photoconductive material effective for producing charge carriers; and a charge transport layer adjacent said charge carrier producing layer, which consists essentially of a hydrazone having the formula

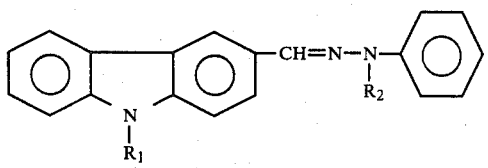

wherein $R_1$ is methyl, ethyl,2-hydroxyethyl, or 2-chloroethyl, and $R_2$ is methyl, ethyl, benzyl or phenyl, and a binder resin selected from the group consisting of polyamide, polyurethane, polyester, epoxy resin, polyketone, polyvinyl ketone, polystyrene, poly-N-vinyl carbazole and polyacrylamide.

2. An electrophotographic element as claimed in claim 1, wherein said charge transport layer comprises a hydrazone selected from the group consisting of:

9-Methylcarbazole-3-carbaldehyde 1-methyl-1-phenylhydrazone;
9-Methylcarbazole-3-carbaldehyde 1-ethyl-1-phenylhydrazone;
9-Methylcarbazole-3-carbaldehyde 1-benzyl-1-phenylhydrazone;
9-Ethylcarbazole-3-carbaldehyde 1-methyl-1-phenylhydrazone;
9-Ethylcarbazole-3-carbaldehyde 1-ethyl-1-phenylhydrazone;
9-Ethylcarbazole-3-carbaldehyde 1-benzyl-1-phenylhydrazone;
9-(β-Hydroxyethyl)carbazole-3-carbaldehyde 1-methyl-1-phenylhydrazone;
9-(β-Hydroxyethyl)carbazole-3-carbaldehyde 1-ethyl-1-phenylhydrazone;
9-(β-Hydroxyethyl)carbazole-3-carbaldehyde 1-benzyl-1-phenylhydrazone;
9-(β-Chloroethyl)carbazole-3-carbaldehyde 1-methyl-1-phenylhydrazone;
9-(β-Chloroethyl)carbazole-3-carbaldehyde 1-ethyl-1-phenylhydrazone;
9-(β-Chloroethyl)carbazole-3-carbaldehyde 1-benzyl-1-phenylhydrazone.

3. An electrophotographic element as claimed in claim 1, wherein said charge transport layer comprises a hydrazone selected from the group consisting of 9-Ethylcarbazole-3-carbaldehyde 1-methyl-1-phenylhydrazone, 9-Ethylcarbazole-3-carbaldehyde 1-ethyl-1-phenylhydrazone and 9-Ethylcarbazole-3-carbaldehyde 1-benzyl-1-phenylhydrazone.

4. An electrophotographic element as claimed in claim 1, wherein said photoconductive material is 1,4-bis[4-{2-hydroxy-3-(2,4-dimethylphenyl)carbamoylnaphthyl-1} azostyryl-1]benzene.

5. An electrophotographic element as claimed in claim 1, wherein said charge transport layer comprises a hydrazole selected from the group consisting of:

9-Methylcarbazole-3-carbaldehyde 1-methyl-1-phenylhydrazone;
9-Methylcarbazole-3-carbaldehyde 1-ethyl-1-phenylhydrazone;
9-Methylcarbazole-3-carbaldehyde 1-benzyl-1-phenylhydrazone;
9-Ethylcarbazole-3-carbaldehyde 1-methyl-1-phenylhydrazone;
9-Ethylcarbazole-3-carbaldehyde 1-ethyl-1-phenylhydrazone;
9-Ethylcarbazole-3-carbaldehyde 1-benzyl-1-phenylhydrazone;
9-(β-Hydroxyethyl)carbazole-3-carbaldehyde 1-methyl-1-phenylhydrazone;
9-(β-Hydroxyethyl)carbazole-3-carbaldehyde 1-ethyl-1-phenylhydrazone;
9-(β-Hydroxyethyl)carbazole-3-carbaldehyde 1-benzyl-1-phenylhydrazone;
9-(β-Chloroethyl)carbazole-3-carbaldehyde 1-methyl-1-phenylhydrazone;
9-(β-Chloroethyl)carbazole-3-carbaldehyde 1-ethyl-1-phenylhydrazone;
9-(β-Chloroethyl)carbazole-3-carbaldehyde 1-benzyl-1-phenylhydrazone;

and said photoconductive material is 1,4-bis[4-{2-hydroxy-3-(2,4-dimethylphenyl)carbamoylnaphthyl-1} azostyryl-1]benzene.

6. An electrophotographic element as claimed in claim 1, wherein said charge transport layer comprises a hydrazone selected from the group consisting of 9-Ethylcarbazole-3-carbaldehyde 1-methyl-1-phenylhydrazone, 9-Ethylcarbazole-3-carbaldehyde 1-ethyl-1-phenylhydrazone and 9-Ethylcarbazole-3-carbaldehyde 1-benzyl-1-phenylhydrazone, and said photoconductive material is 1,4-bis[4-{2-hydroxy-3-(2,4-dimethylphenyl)carbamoylnaphthyl-1} azostyryl-1]benzene.

* * * * *